US005682654A

United States Patent [19]

Crowley et al.

[11] Patent Number: 5,682,654

[45] Date of Patent: Nov. 4, 1997

[54] CLOSURE ELEMENT

[75] Inventors: Kevin J. Crowley, Brentwood, N.H.; Rui Paracho, Peabody, Mass.

[73] Assignee: Fila U.S.A., Inc., Sparks, Md.

[21] Appl. No.: 634,700

[22] Filed: Apr. 18, 1996

[51] Int. Cl.[6] ..... A43C 1/04

[52] U.S. Cl. ..... 24/714.9; 36/50.1; 24/714.6

[58] Field of Search ..... 24/712.1–712.5, 24/712.9, 713.9, 714.1, 714.2, 714.9, 715.3; 36/50.1; 273/1.5 R

[56] References Cited

U.S. PATENT DOCUMENTS

| | | | |
|---|---|---|---|
| 76,234 | 3/1868 | Nealey, Jr. | 24/714.9 |
| 216,857 | 6/1879 | Jones | 24/714.9 |
| 596,584 | 1/1898 | Glenn, Jr. | 24/714.9 |
| 704,381 | 7/1902 | Savoye | 24/714.9 |
| 805,582 | 11/1905 | Prentice | 24/714.9 |
| 889,770 | 6/1908 | Dorothy . | |
| 891,811 | 6/1908 | Brooks | 24/714.9 |
| 1,070,797 | 8/1913 | Gordon | 24/714.9 X |
| 1,174,641 | 3/1916 | Weatherley | 24/714.9 X |
| 1,403,397 | 1/1922 | Flannery | 24/714.2 |
| 1,483,702 | 2/1924 | Weingrten | 24/714.9 X |
| 1,548,407 | 8/1925 | Chisholm | 24/714.9 |
| 1,850,781 | 3/1932 | Weingarten | 24/714.9 X |
| 2,053,635 | 9/1936 | Sandeberg | 273/1.5 R |
| 3,768,182 | 10/1973 | Powers | 36/54 X |
| 4,553,342 | 11/1985 | Derderian et al. | 36/97 |
| 4,628,622 | 12/1986 | McBarron | 36/50 |
| 4,670,949 | 6/1987 | Autry | 24/140 |
| 5,042,120 | 8/1991 | Nichols | 24/713.2 |
| 5,259,094 | 11/1993 | Zepeda | 24/712 |
| 5,291,671 | 3/1994 | Caberlotto et al. | 36/88 |
| 5,293,675 | 3/1994 | Shai | 24/712.1 |
| 5,335,401 | 8/1994 | Hanson | 24/712.5 |
| 5,353,483 | 10/1994 | Louviere | 24/712.1 |
| 5,469,640 | 11/1995 | Nichols | 24/712.1 X |

FOREIGN PATENT DOCUMENTS

| | | | |
|---|---|---|---|
| 505539 | 7/1920 | France | 24/715.3 |

*Primary Examiner*—Jose V. Chen
*Assistant Examiner*—Robert J. Sandy
*Attorney, Agent, or Firm*—Fish & Richardson P.C.

[57] ABSTRACT

A closure element for attachment to an item is disclosed. The closure element has a helical lacing structure, at least one support brace and a base. In an alternate embodiment, at least one hook structure is part of the helical lacing structure.

27 Claims, 7 Drawing Sheets

CLOSURE ELEMENT

FIELD OF THE INVENTION

This invention relates in general to closure systems that utilize cords or laces, and more particularly to a closure element that may be used in the closure system for a shoe, garment or any other item.

BACKGROUND OF THE INVENTION

Many articles employ closure systems having eyelets and laces. For example, garments, tents, tarps, laundry bags and the like typically use cords or lacings threaded through apertures to secure a flap or opening. In particular, most athletic shoes utilize eyelets and shoelaces.

An athletic shoe is generally divided into two parts, an upper designed to comfortably enclose a wearer's foot, and a sole for contacting a surface. Typically, the upper of an athletic shoe includes a throat having a tongue, and may be formed of several layers that are stitched or glued together. The closure system of a laced shoe conventionally employs a shoelace threaded from the bottom of the throat of the shoe through two rows of opposing, equally spaced eyelets located on opposite sides of the throat. The two ends of the shoelace are pulled tight and tied in a bow to secure the shoe to the foot.

Each time the shoe is to be removed, the bow is untied and the two ends of the shoelace are loosened from the eyelets. The edges of the throat are then spread apart to loosen the tongue, and then the foot is slipped out of the shoe.

When the shoe is again to be worn, the shoelace is further loosened between several of the eyelets so that extra room is provided for the foot to be comfortably slipped into the shoe. The two ends of the shoelace are then pulled to take up the slack in the lace and the two ends are tied together.

Before and during athletic activities such as running, basketball, tennis and other sports, the laces of an athletic shoe must be carefully adjusted by the wearer to effect the proper tension of the tied shoelace and the shoe onto the foot. Such adjustments take time, and require the wearer to readjust the length of the lace between the eyelets.

SUMMARY OF THE INVENTION

A closure element for use as part of a closure system ameliorates the present time-consuming task of adjusting individual laces of a shoe to achieve the necessary fit. The closure element has a helical lacing structure to receive and guide a lace or cord, at least one support brace and a base: A plurality of closure elements may be used to form a closure system for a shoe, garment, tent, tarp or other item.

An alternative embodiment of the closure element has a helical lacing structure that incorporates a hook element, at least one support brace, and a base. The wearer may hook a lace between the gaps of the hook structure instead of threading the lace through the helical structure.

The disclosed closure elements may be used in a shoe closure system to permit the user to quickly and efficiently attach the shoe to the foot. As the wearer walks in the shoe, the tension between opposing closure elements automatically adjusts to provide a firm, yet comfortable fit.

DESCRIPTION OF THE PREFERRED EMBODIMENTS

Figure 1A:
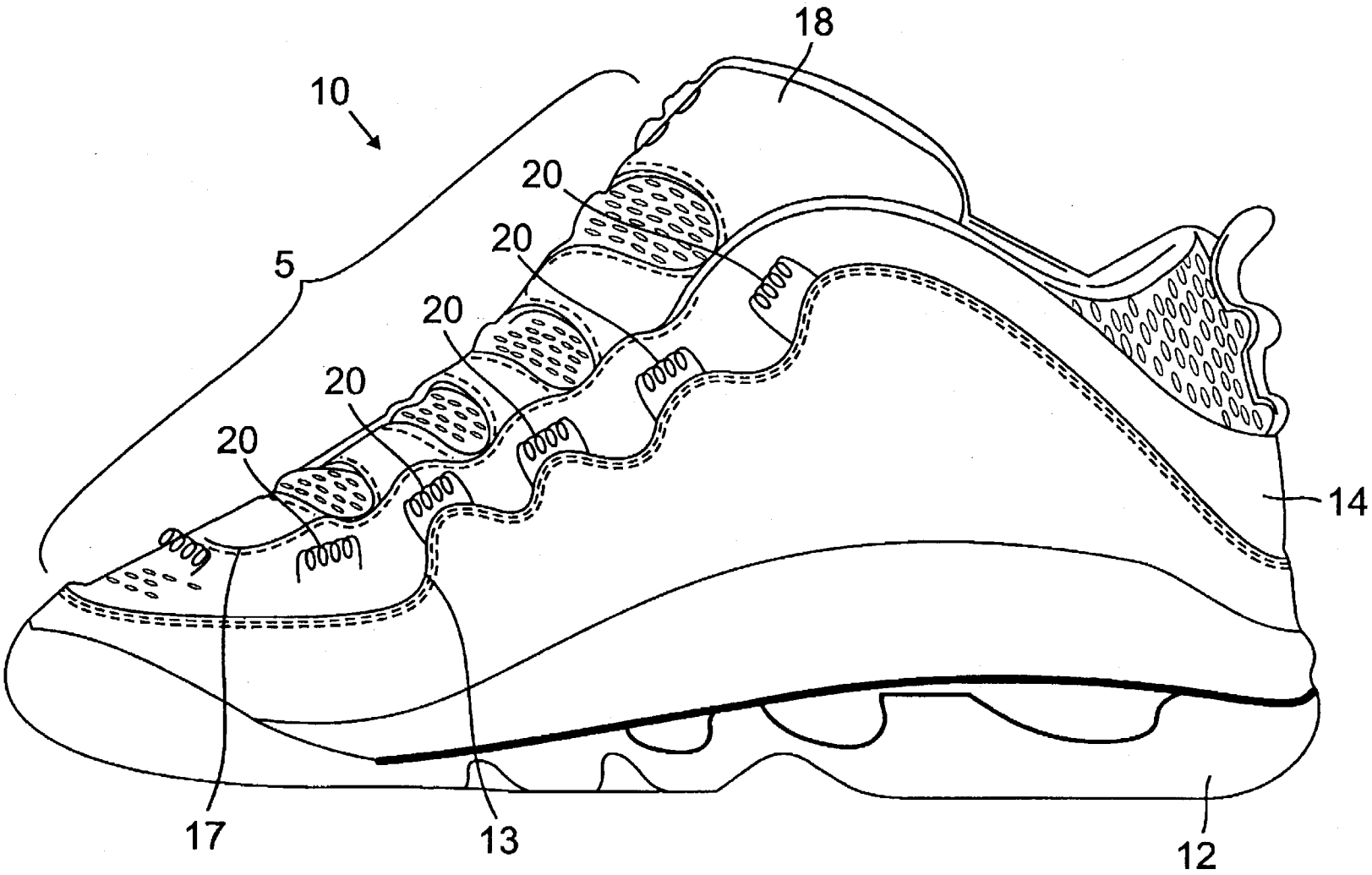
FIG. 1A is a side view of a shoe containing closure elements according to the invention.
Figure 1B:
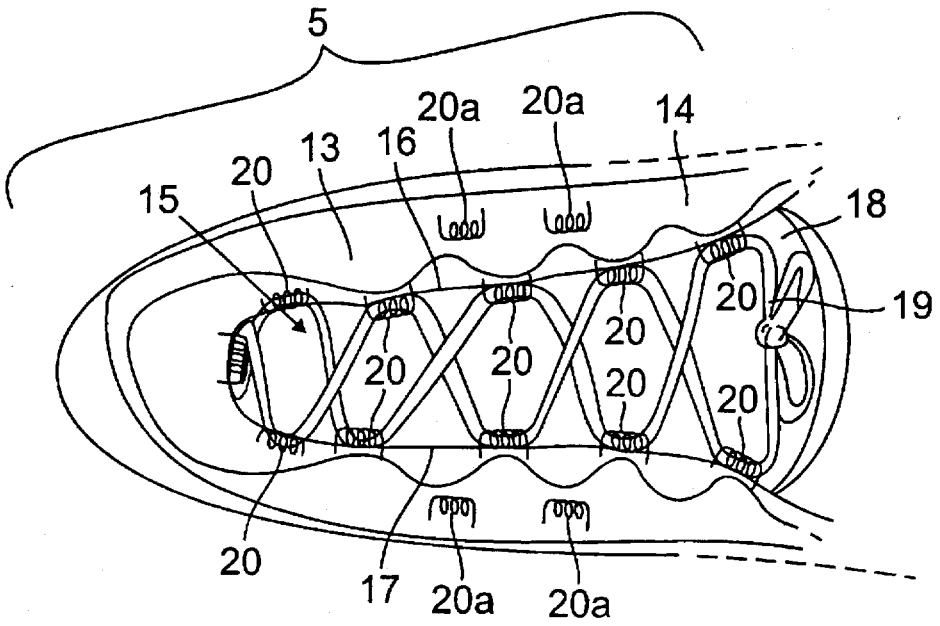
FIG. 1B is a top view of the front portion of the shoe of FIG. 1A.

FIG. 1A is a side view of a shoe 10 having a sole 12 and an upper 14. FIG. 1B is a top view of the front portion 5 of the upper 14 of the shoe 10 of FIG. 1A. The upper 14 includes a throat 15 which has opposing facing sides 16 and 17. A tongue 18 extends through the throat 15. The shoe 10 is fastened to a wearer's foot by a shoelace 19 threaded through a closure system. An automatically adjustable tension closure system according to the present invention includes a plurality of closure elements 20.

Figure 1D:
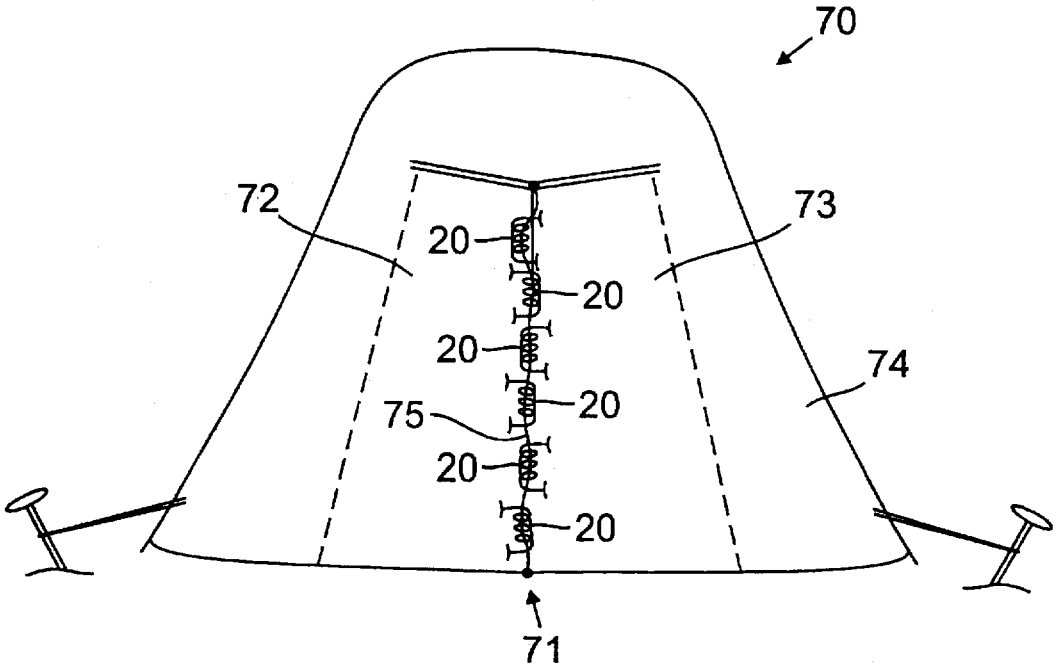
FIG. 1D is a front view of a tent containing closure elements according to the invention.
Figure 1C:
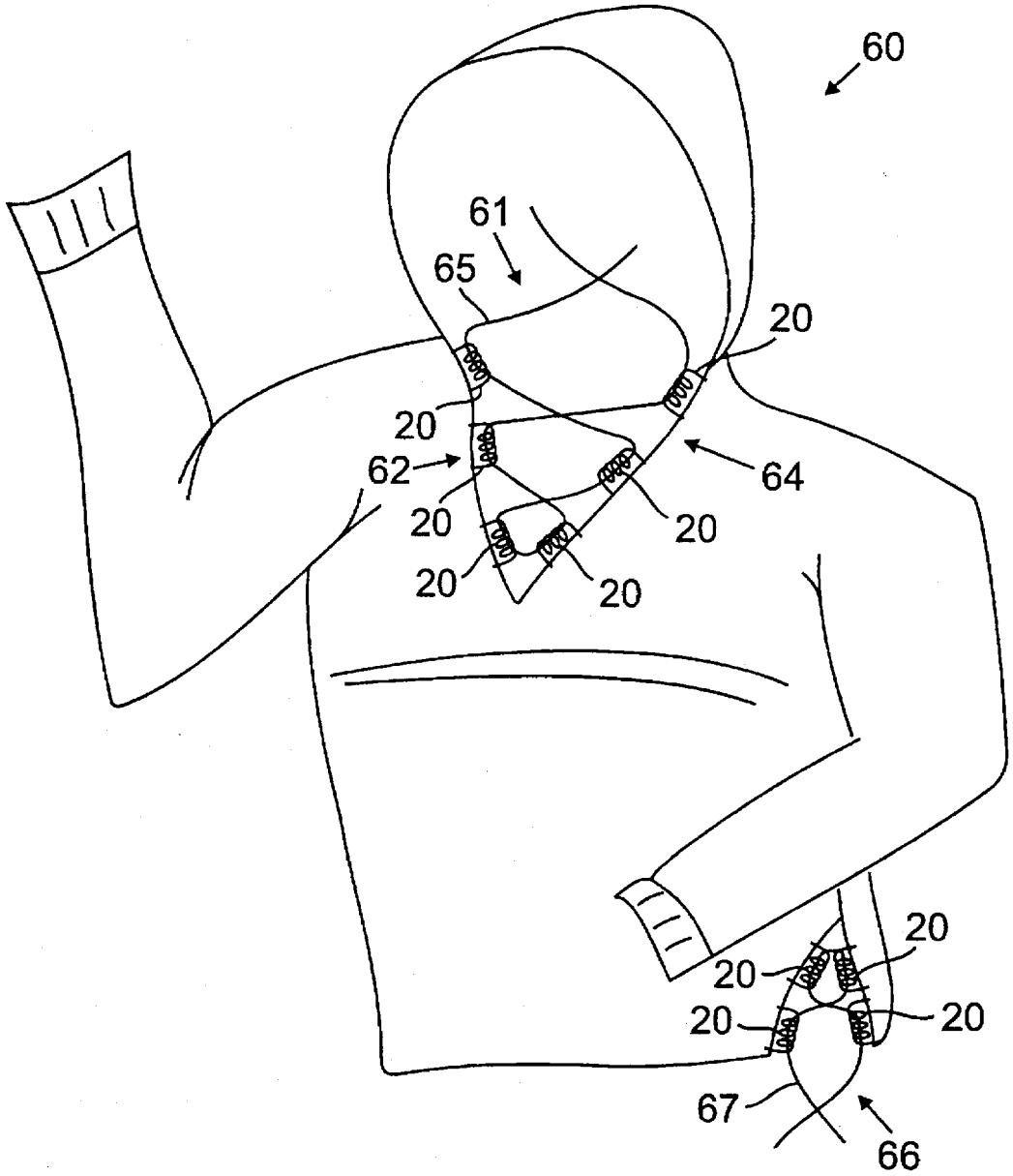
FIG. 1C is a front view of an article of clothing containing closure elements according to the invention.

FIG. 1C is a front view of a hooded sweatshirt 60 employing a closure system 61 utilizing closure elements according to the invention. In particular, the closure elements 20 are shown attached opposite each other in an even configuration on a first side 62 and second side 64 of the upper chest portion 63 of the sweatshirt 60. The phrase "even configuration" connotes that each closure element 20 on the first side 62 is matched with a closure element 20 on the second side 64. A drawstring or lace or cord 65 made of cotton or other material is threaded through the closure elements 20. A second closure system 66 is shown which also employs closure elements 20 in an even configuration and a drawstring 67. The closure systems 61 and 66 enable the wearer of the sweatshirt 60 to quickly and easily cinch the sweatshirt to the body to provide a snug fit.

FIG. 1D is a front view of a tent 70 having closed flaps 72, 73 containing a closure system 71 utilizing closure elements according to the invention. In particular, closure elements 20 are shown attached to the tent flaps 72, 73 in a staggered configuration to the front 74 of the tent 70. The phrase "staggered configuration" means that the closure elements 20 on tent flap 72 are not directly across from, and thus do not line up with, the closure elements 20 on tent flap 73. In FIG. 1D, a cord 75 made of leather or other material is threaded through the lacing elements 20 and pulled taut from inside the tent 70 to quickly and securely close the tent flaps 72 and 73. Since the closure elements 20 are connected in a staggered configuration, when the cord 75 is pulled taut the helical lacing structures 26 (shown, for example, in FIGS. 2A and 2B) of the closure elements 20 will line up to tightly close the tent flaps 72, 73 as shown. Such quick and tight closure is advantageous, for example, to keep rain or snow from contacting a camper inside the tent 70.

It should be apparent from the above examples depicted in FIGS. 1A–1D that closure elements according to the invention could be used in closure systems for numerous applications. For example, the closure elements could be used on tarps, on pick-up truck bed liners, on various articles of clothing, and on other items.

Figure 2A:
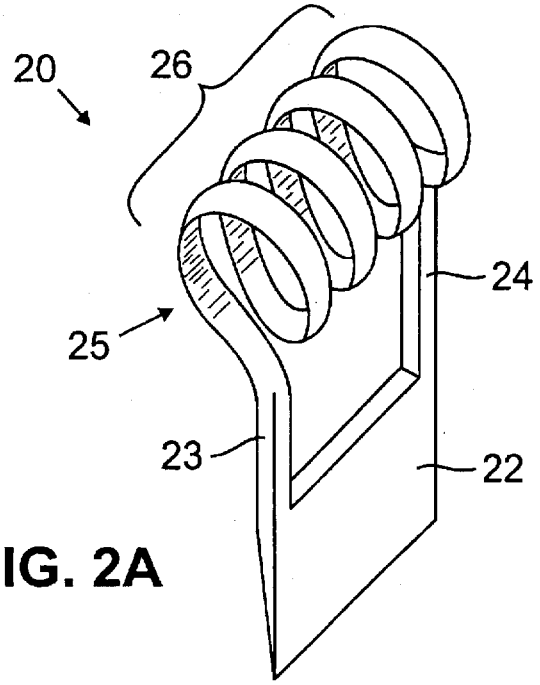
FIGS. 2A, 2B and 2C are a perspective view, a front view and a side view, respectively, of a closure element according to an embodiment of the invention.

FIG. 2A is a perspective view of a closure element 20 according to the invention. The closure element 20 includes a base portion 22, support braces 23, 24 and a helical lacing structure 26. The helical lacing structure 26 is in the shape of a spring, and like a spring is somewhat elastic to provide tension when a lace or cord is pulled taut. In particular, a characteristic of a spring is the ability to store and release energy when bent or twisted. Similarly, when a shoelace, for example, is threaded through the helical lacing structure 26 of each of the closure elements 20 on a shoe 10 and then pulled taut, as shown in FIG. 1B, initially an uneven tension may exist along the closure system. However, as the wearer takes a few steps in the shoe the helical structure of each of the closure elements 20 will coil or uncoil to redistribute the tension among themselves which results in a comfortable fit of the shoe to the foot.

Figure 2B:
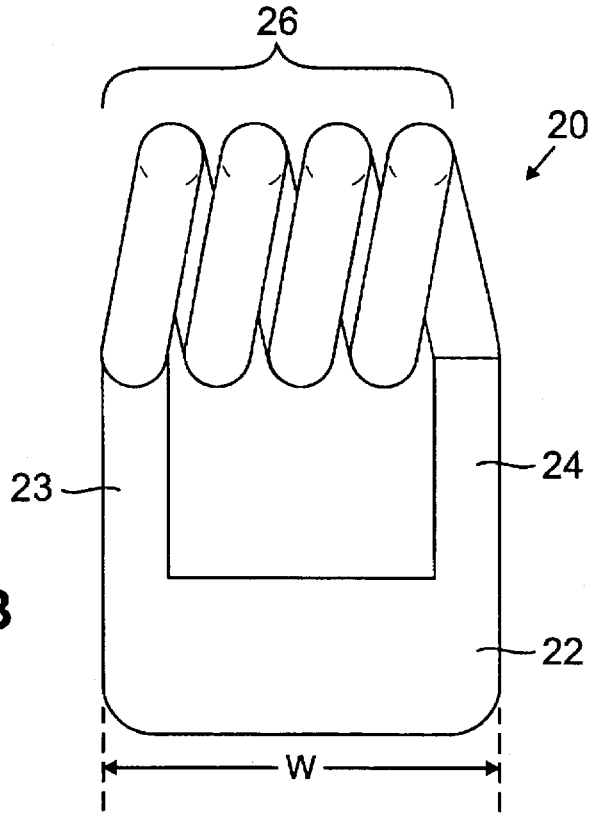
Figure 2C:
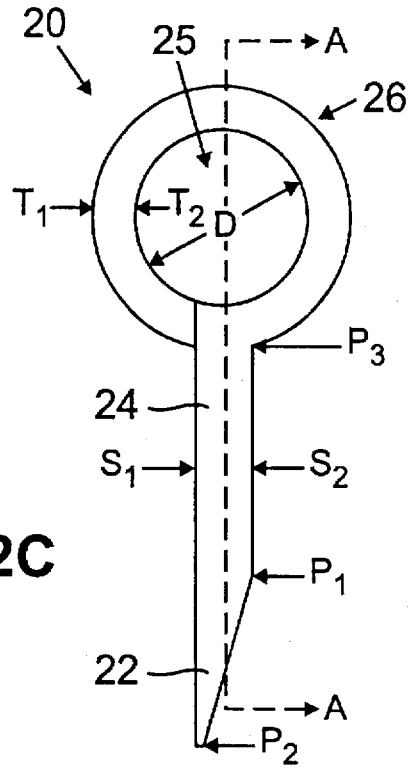

FIG. 2B is a front view and FIG. 2C is a side view of the closure element 20 of FIG. 2A. The helical lacing structure 26 as shown in FIGS. 2A–2D has four turns to define four closed circles, but may contain as few as two turns or as many as six turns. In the example shown, the circular opening 25 through the helical lacing structure 26 is sized to permit easy lacing of shoelaces. The base 22 may be sewn or rivetted, for example, to a layer of the upper material 13 of a shoe 10 (see, for example, FIGS. 1A and 1B).

Referring to the side view of the closure element 20 in FIG. 2C, the diameter D of the opening 25 through the turns of the helical lacing structure 26 for use with a shoelace is approximately 7 millimeters, but may be as small as 3.5 millimeters. An opening having a diameter D on the order of 3.5 to 7 millimeters is larger than the uncompressed cross-section of a shoelace, which permits a shoelace to pass freely through the helical structure 26. Thus, an athletic shoe having a plurality of opposing closure elements 20 as shown in FIGS. 1A and 1B may be quickly laced closed by threading the shoelace through the openings 25 of each closure element 20 and pulling tightly on the ends of the shoelace. Of course, if the closure element 20 were being used in an application other than that for a shoe, such as those shown in FIGS. 1C or 1D, then a larger or smaller size opening 25 could be used depending on the drawstring, cord, or lace that would be utilized.

Referring again to FIG. 2C, the thickness between arrows $T_1$–$T_2$ of the helical lacing structure 26 is preferably about 2 millimeters, and the thickness between arrows $S_1$–$S_2$ of the support braces 23, 24 is preferably about 3 millimeters. As shown, the base portion 22 is ramp shaped, and is approximately 3 millimeters thick at point $P_1$ and 0.5 millimeters thick at point $P_2$. The ramp shape of the base to permits stitches to be more easily sewn therethrough, or allows rivets to more easily pass therethrough. The length from point $P_3$ at the top of the support brace 24 to the point $P_2$ at the bottom of the base is approximately 22 millimeters, and the width W (shown in FIG. 2B) of the base is approximately 22 millimeters.

A shoelace may have up to 120 pounds of force applied when a user pulls the shoelaces taut. Therefore, a closure element 20 must be sufficiently strong to retain the circular shape of the openings through the helical structure 26 when under such stress, yet be sufficiently flexible to deform slightly so that the shoelace will self-adjust for comfort. Consequently, the closure element 20 may be a thermal formed linear piece comprised of a semi-rigid plastics material, or of a rubberized high density plastic. Alternately, the closure element may be manufactured of a high density polyurethane, or may be made of metal, or of a composite of materials, such as metal wire coated with a rubber or plastic material. The closure element 20 may be fabricated in an injection molding process, or may be formed as a one-piece metallic component.

Figure 2D:
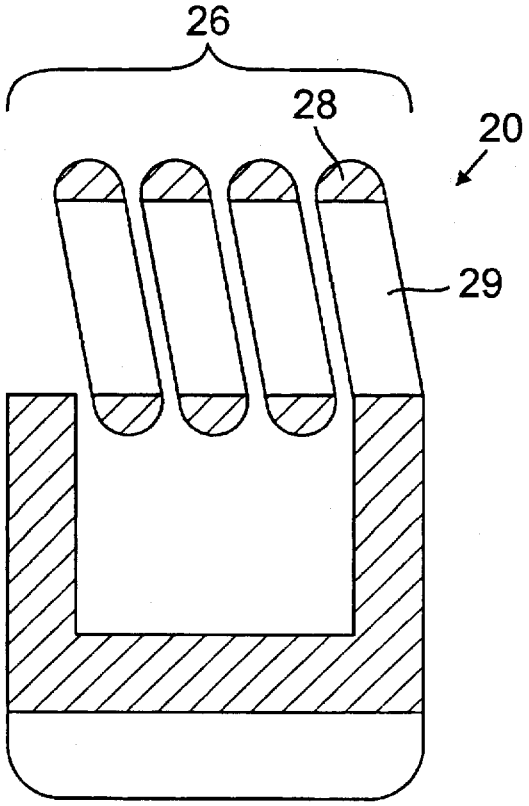
FIG. 2D is a cross-sectional view of the closure element of FIG. 2C taken along line A—A.

FIG. 2D is a cross-sectional front view of the closure element 20 taken along line B—B of FIG. 2C. As shown, the cross-sectional area 28 of the helical structure 26 has a semi-circular shape, to define a flat and smooth interior surface 29 to permit a shoelace to pass therethrough with a minimal amount of friction. One of skill in the art, however, recognizes that the cross-sectional area 28 may be spherical or some other shape, which may depend on the application and/or the method of fabrication.

Referring to FIG. 1B, the shoelace 19 is shown threaded through the closure elements 20 which are evenly spaced about the opposing edges 16 and 17 of the throat 15. However, closure elements 20*a* are also shown attached to the upper 14 at locations that are further away from the throat 15. Thus, a wearer may thread the shoelace 18 through some or all of the closure elements 20 and 20*a*. Alternately, closure elements may be attached at other locations away from the throat 15. In addition, the closure elements 20 could be unevenly spaced in a staggered configuration, for example, on opposite sides of the throat 15. Such alternative configurations could be used to achieve different tensioning configurations. For example, three closure elements 20 may be connected on side 16, while five closure elements 20 could be connected on side 17. Such alternate configurations may be beneficial for people having feet of various widths and/or varying personal preferences about snugness of fit of the shoe to the foot. Thus, a shoe manufacturer can attach the closure elements 20 in different configurations to construct various lacing systems.

Figure 3A:
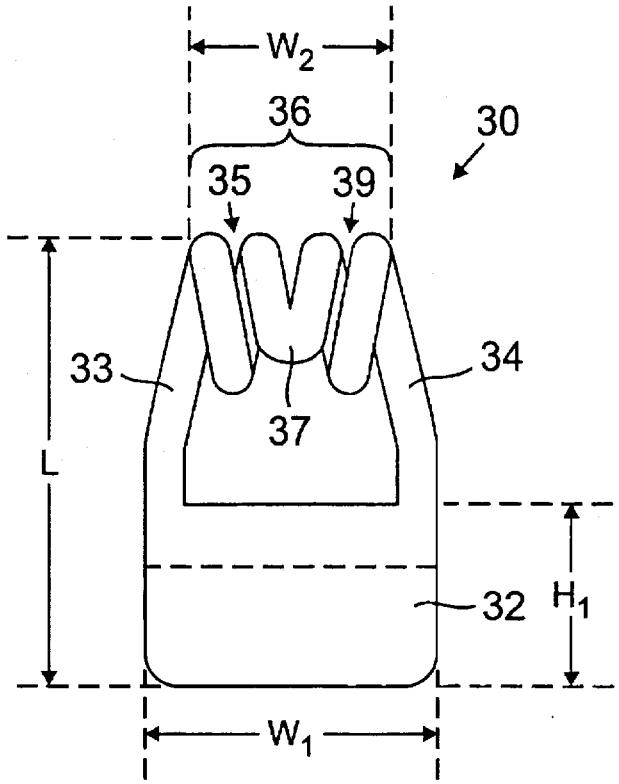
FIGS. 3A and 3B are front and side views, respectively, of an alternate embodiment of a closure element according to the invention.

FIGS. 3A and 35 depict an alternate embodiment of a closure element 30 for use in a closure system. FIG. 3A is a front view of the closure element 30 which includes a base 32, angled support braces 33, 34 and a generally helical structure 36. The helical structure 36 contains a hook element 37, which is explained in detail below. In the example shown, the closure element 30 is for use in a closure system for a shoe. The dimensions are therefore as follows: The width $W_1$ of the base is approximately 24 millimeters, and the height $H_1$ is approximately 15 millimeters. The total length n from the bottom of the based to the top of the helical structure 36 is approximately 37 millimeters. The width $W_2$ of the helical structure is approximately 16.5 millimeters.

Figure 3B:
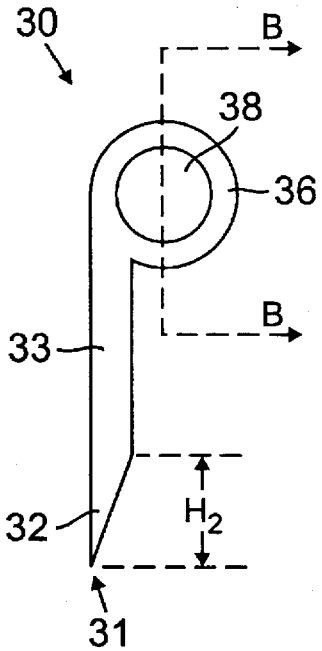

FIG. 3B is a side view of the closure element 30 of FIG. 3A, illustrating the circular-shaped opening 38 through the helical structure 36. The diameter of the opening 38 is preferably between 3.5 and 7.5 millimeters to permit easy lacing of a shoelace therethrough, but smaller or larger size openings can be used depending on the application, and the turns of the helical structure 36 are approximately 2 millimeters thick. The base 32 has a ramp-shaped portion having a length $H_2$ of approximately 10 millimeters. The ramp-shaped portion of the base 32 permits stitches to be more easily sewn therethrough, or allows rivets to more easily pass therethrough. The thickness of the support braces 33, 34 is approximately 3 millimeters, and the thinnest part of the base 32 at point 31 is approximately 0.5 millimeters thick.

As discussed above, a closure element for use with a shoelace must be strong, yet flexible, to counteract the stress applied when the laces are pulled taut and to permit the shoelace to self-adjust for comfort. Consequently, the closure element 30 may be a thermal formed linear piece composed of a semi-rigid plastic material, or of a rubberized high density plastic. Alternately, the closure element may be made of a high density polyurethane, or may be made of metal, or may be of a composite material such as a metal wire coated with a rubber or plastic material. The closure element 30 may be fabricated in an injection molding process or may be formed as a one-piece metallic component.

Referring again to FIG. 3A, a hook structure 37 is shown in the middle of the width $W_2$. The hook structure 37 permits a wearer to hook a shoelace between the gaps 35 and 39, rather than thread the shoelace through opening 38 (shown in FIG. 3B). The spaces 35, 39 are thus 3.5 millimeters wide or wider to allow a shoelace to be easily threaded thereabout, but may be smaller or larger for other applications. This feature enables the wearer of a shoe to attach the shoelace to the closure element 30 very quickly. It should be understood that two or more hook structures could be formed along the length of the helical structure 36 to enable a wearer to choose one or more points of attachment at that closure element 30 for the shoelace. If a plurality of closure elements 30 are used to form a shoe lacing system on opposite sides 16, 17 of a throat of a shoe (as shown in FIGS. 1A and 1B), a wearer could choose to thread the shoelace through the opening 38 of some of the closure elements 30 and hook the shoelace about the hook structure 37 of other closure elements 30. Such a configuration would provide alternative tensions along the tongue of the shoe.

Figure 3C:
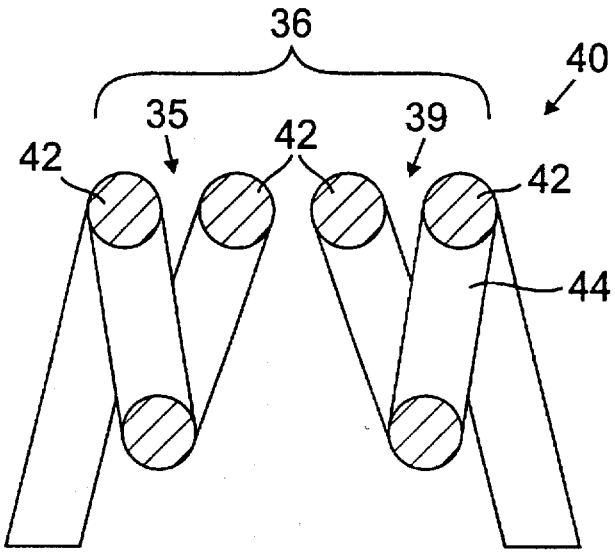
FIG. 3C is a first embodiment of a cross-sectional area of a helical lacing structure taken along line B—B of FIG. 3B.

FIG. 3C is a first cross-sectional embodiment 40 taken along line B—B of FIG. 3B of the helical structure 36. As shown, the cross-sectional area 42 is spherical. Thus, the inner surface 44 which contacts a lace or cord is rounded which minimizes friction between the lace and the closure element as the lace is either hooked thereon or threaded therethrough.

Figure 3D:
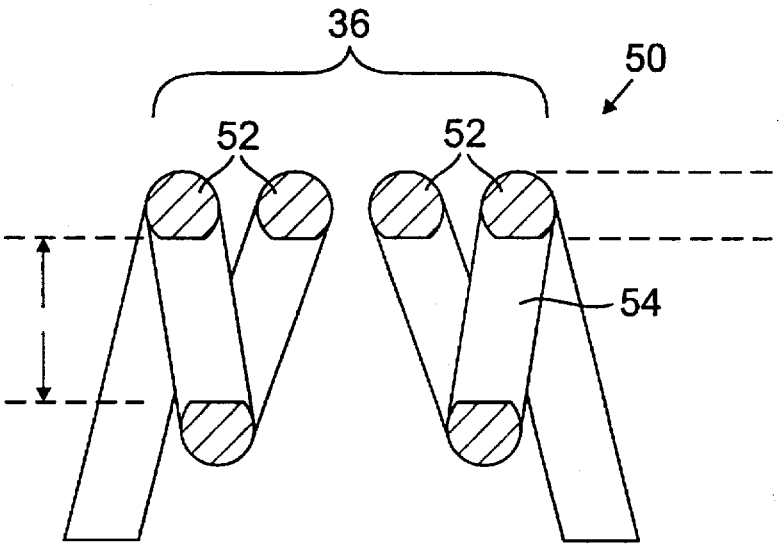
FIG. 3D is a second embodiment of a cross-sectional area of a helical lacing structure taken along line B—B of FIG. 3B.

FIG. 3D is a second cross-sectional embodiment 50 taken along line B—B of FIG. 3B of the helical structure 36. As shown, cross-sectional area 52 is semi-circular in shape. Thus, the inner surface 54 which contacts a lace or cord is flat. Such a flat inner surface introduces slightly more friction than the rounded surface of the cross-sectional area 42 of FIG. 3C, however, such a structure may be desirable for some applications. In addition, it may be easier to manufacture a helical structure with a flat inner surface when using certain materials.

Although the invention has been described with reference to specific embodiments, it should be understood that other modifications would be apparent to one skilled in the art without departing from the spirit and scope of the invention, which is defined by the appended claims.

What is claimed is:

1. A tensioning closure element to receive and guide a lace, comprising:

an elastic helical lacing structure having gaps between turns and having a first end and a second end, wherein the helical lacing structure defines a circular pathway to guide the lace;

first and second support braces each having first ends attached to the first and second ends of the helical lacing structure, wherein the support braces have second ends and are substantially parallel to each other and perpendicular to the pathway; and a ramped base structure connected to the second ends of the first and second support braces.

2. The closure element of claim 1, wherein the helical lacing structure contains at least two turns.

3. The closure element of claim 1, wherein the helical lacing structure further comprises:

at least one hook structure.

4. The closure element of claim 3, wherein gaps are formed by the hook structure through which a lace may be hooked.

5. The closure element of claim 4, wherein the gaps are at least 3.5 millimeters wide.

6. The closure element of claim 1, wherein the interior surface of the helical lacing structure is flat.

7. The closure element of claim 1, wherein the interior surface of the helical lacing structure is rounded.

8. An automatically adjustable tension speed lace system for the throat of a shoe, comprising:

a plurality of tensioning closure elements, each attachable on opposite sides of the throat of the shoe in an even configuration, wherein each closure element comprises an elastic helical lacing structure having gaps between turns and that defines a circular pathway to guide the lace, a first and second support brace attached to each end of the helical lacing structure wherein the support braces are substantially parallel to each other and perpendicular to the pathway, and a base connected to the first and second support braces.

9. The speed lace system of claim 8, wherein the helical lacing structure of at least one of the closure elements comprises at least one hook structure.

10. The speed lace system of claim 9, wherein gaps are formed by the hook structure through which a lace may be hooked.

11. The speed lace system of claim 10, wherein the gaps are at least 3.5 millimeters wide.

12. The speed lace system of claim 8, further comprising at least one closure element attachable to the upper of a shoe in a location away from the throat to achieve a different tensioning configuration.

13. An automatically adjustable tension speed lace system for the throat of a shoe, comprising:

a plurality of tensioning closure elements, each attachable on opposite sides of the throat of the shoe in a staggered configuration, wherein each closure element comprises an elastic helical lacing structure having gaps between turns and that defines a circular pathway to guide the lace, a first and second support brace attached to each end of the helical lacing structure wherein the support braces are substantially parallel to each other and perpendicular to the pathway, and a base connected to the first and second support braces.

14. The speed lace system of claim 13, wherein the helical lacing structure of at least one of the closure elements comprises at least one hook structure.

15. The speed lace system of claim 14, wherein the gaps are formed by the hook structure through which a lace may be hooked.

16. The speed lace system of claim 15, wherein the gaps are at least 3.5 millimeters wide.

17. The speed lace system of claim 13, further comprising at least one closure element attachable to the upper of a shoe in a location away from the throat to achieve a different tensioning configuration.

18. An automatically adjustable tension closure system for an article, comprising: p1 a plurality of tensioning closure elements arranged to accept a cord which can be pulled taut to close an opening, wherein each closure element comprises an elastic helical lacing structure having gaps between turns and that defines a circular pathway to guide the lace, a first and second support brace attached at each end of the helical lacing structure wherein the support braces are substantially parallel to each other and perpendicular to the pathway, and a base connected to the first and second support braces.

19. The closure system of claim 18, wherein the helical lacing structure further comprises:

at least one hook element.

20. The closure speed lace system of claim 19, wherein gaps are formed by the hook structure through which a lace may be hooked.

21. The closure element of claim 1, wherein the inner diameter of the helical lacing structure is 3.5 mm to 7 mm.

22. The closure element of claim 1, wherein the base structure is ramp shaped.

23. The closure element of claim 1, wherein the helical lacing structure, support braces and base structure are made of a thermal-formed material.

24. The closure element of claim 23, wherein the thermal-formed material is a semi-rigid plastic.

25. The closure element of claim 23, wherein the thermal-formed material is a rubberized high-density plastic.

26. The closure element of claim 1, wherein the closure element is made of a high density polyurethane material.

27. The closure element of claim 1, wherein the closure element is made of metal.

* * * * *

UNITED STATES PATENT AND TRADEMARK OFFICE

CERTIFICATE OF CORRECTION

PATENT NO. : 5,682,654

DATED : November 4, 1997

INVENTOR(S) : Kevin J. Crowley and Rui Paracho

It is certified that error appears in the above-identified patent and that said Letters Patent is hereby corrected as shown below:

Col. 4, line 39, cancel "35" and insert --3B--.

Col. 4, line 49, cancel "n" and insert --L--.

Col. 6, line 64 (claim 18), after "comprising:", cancel "p1" and insert a new paragraph.

Col. 7, line 10 (claim 20), cancel "speed lace".

Signed and Sealed this

First Day of December, 1998

*Attest:*

*Attesting Officer*

BRUCE LEHMAN

*Commissioner of Patents and Trademarks*